US007562758B2

(12) United States Patent
González Alemany et al.

(10) Patent No.: US 7,562,758 B2
(45) Date of Patent: Jul. 21, 2009

(54) SAFETY DEVICE FOR TRANSPORT SYSTEMS

(75) Inventors: Miguel Angel González Alemany, Oviedo (ES); Juan Domingo Gonzalez Pantiga, Gijón (ES); Manuel Alonso Cuello, Gijón (ES); José Mendiolagoitia Juliana, Gijón (ES)

(73) Assignees: Thyssenkrupp Norte, S.A., Asturias (ES); Thyssenkrupp Elevator (ES/PBB) Ltd., London (GB)

( * ) Notice: Subject to any disclaimer, the term of this patent is extended or adjusted under 35 U.S.C. 154(b) by 0 days.

(21) Appl. No.: 11/964,339

(22) Filed: Dec. 26, 2007

(65) Prior Publication Data

US 2008/0164118 A1 Jul. 10, 2008

(30) Foreign Application Priority Data

Dec. 28, 2006 (ES) ..... 200603299

(51) Int. Cl.
*B65B 25/00* (2006.01)

(52) U.S. Cl. ..... 198/323; 198/322

(58) Field of Classification Search ..... 198/322, 198/323, 334

See application file for complete search history.

(56) References Cited

U.S. PATENT DOCUMENTS 4,232,776 A * 11/1980 Dean ..... 198/322
4,438,830 A * 3/1984 Born ..... 198/323
4,863,006 A * 9/1989 Kotkata et al. ..... 198/323
5,236,075 A * 8/1993 Bartmann ..... 198/323
5,571,254 A 11/1996 Saeki et al.
6,675,949 B1 * 1/2004 Gonzalez Alemany et al. ... 198/334

FOREIGN PATENT DOCUMENTS

| | | |
|---|---|---|
| EP | 0 646 538 | 4/1995 |
| EP | 0 850 870 | 7/1996 |
| EP | 0 773 182 | 5/1997 |
| EP | 0 831 052 | 3/1998 |
| EP | 0 854 108 | 7/1998 |
| ES | 2 179 720 | 1/2003 |
| FR | 2 747 664 | 10/1997 |
| GB | 2 025 872 | 1/1980 |
| GB | 2 264 686 | 9/1993 |

* cited by examiner

*Primary Examiner*—James R Bidwell
(74) *Attorney, Agent, or Firm*—Merchant & Gould P.C.

(57) ABSTRACT

A safety device is provided for transport systems such as walkways and stairs that include moving elements (1, 2) with longitudinal movements and in which one of the moving elements (1, 2) may undergo tilting movements in relation to an operating direction. A safety counter-guide (7) is arranged on the moving elements (1, 2) and prevents the upward tilting of the moving elements (1, 2). The safety counter-guide also includes a lower sensor (8) in the form of a band that generates a stop signal for the system upon coming into contact with moving elements (1, 2). Since the moving elements (1, 2) cannot tilt in an upwards direction, possible risks both for the user and for the mechanical system are prevented.

2 Claims, 2 Drawing Sheets

SAFETY DEVICE FOR TRANSPORT SYSTEMS

FIELD OF THE INVENTION

The present invention relates to a safety device, especially conceived for mechanical walkways, of the type mainly designed for transporting people, although the device could be equally applicable to walkways to transport materials provided that acceleration and deceleration areas are provided in said walkway.

The object of the invention is to prevent and detect the lifting of the pallets participating in said walkway, specifically in the mentioned acceleration and deceleration areas thereof.

The invention is applied to mechanical walkways such as those used in airports, stations and generally in large public places in which users must walk more or less large sections and in which it is intended to make this type of movement easier.

BACKGROUND OF THE INVENTION

In any mechanical walkway of those previously mentioned, several sections acting at different speeds are usually provided, such that following the direction of use thereof a first embarking area, a second slow speed area, an acceleration area, a larger maximum speed intermediate area, a deceleration area, a new slow speed area, and finally the disembarking area are established in said walkways.

In order to obtain the necessary variable speed in the acceleration and deceleration areas, there are various solutions among which the following must be pointed out:

- A variable speed walkway formed by various rubber belts circulating at a constant speed. The rubber belts at the ends circulate at a slower speed, and the central rubber belt circulates at a faster speed, whereby a slower speed when embarking and disembarking is obtained. Walkways with these features are described in patent documents EP 0854108 A-1, EP 0850870 A-1 and EP 0773182 A-2.
- A variable speed walkway formed by telescopic plates. In this solution speed variation is achieved by separating some transporting plates from others. The gap that is produced is covered by sheets that initially are concealed below the surface of the adjacent plate. A walkway with these features is described in patent document GB 2264686 A.
- A variable speed walkway formed by parallelepipedic plates that move laterally in relation to each other. The speed variation is achieved by changing the operating direction, maintaining the projection of the speed on the embarking and disembarking direction constant. This walkway has a typical S shape. Walkways with these features described in patent documents U.S. Pat. No. 5,571,254 and EP 0646538 A2.
- A variable speed walkway formed by a set of motorized and interconnected grooved rollers. The rollers have a small diameter, thus making the use surface approximately flat. The speed variation is achieved by making some rollers rotate quicker than others. In one variant of this walkway these rollers are only used in the acceleration and deceleration areas. The constant speed areas are solved with rubber belts similar to those currently used to transport people such as described in patent document FR 2747664 A1.

- A variable speed walkway formed by a rubber belt that can be deformed. This continuous belt is capable of becoming longer in the central area and getting wider in the embarking and disembarking area, thus achieving the speed variation, as described in patent document EP 0831052 A1.
- A variable speed walkway formed by many overlapping plates. The speed variation is obtained by moving some plates in relation to others, as described in patent documents GB 2025872 and P009902555.

Specifically in this last patent, two types of plates or pallets having different lengths and alternately arranged are used as a moving surface of the walkway, each pair of pallets both being linked to each other according to an axis perpendicular to the operating direction.

The larger rear pallet is assembled on two lateral drive chains and on lateral drive guides, assuring perfect guiding for same, whereas the smaller front pallets have lateral rolling or sliding elements, moveable on the lateral guides of the rear pallet, such that both pallets undergo a relative longitudinal movement during the acceleration and deceleration phases.

This solution, perfectly valid from the theoretical point of view, has one drawback in practice since the shorter front pallet tends to be lifted due to any accidental cause that tends to lock both pallets during the relative movement thereof, which is dangerous for both the user and the mechanical system.

This can occur both by the accidental introduction of any small object between both pallets as well as by the deliberate lifting of the walkway on the part of the user.

SUMMARY OF THE INVENTION

The device proposed by the invention solves the problem set forth above in a fully satisfactory manner, preventing under any circumstance that the front and shortest pallet tilts, therefore preventing that said pallet is lifted with respect to the general working plane of the mechanical walkway.

To that end, more specifically and starting from a basic structure for the mechanical walkway as previously mentioned, the safety device proposed by the invention is created in a safety counter-guide acting as a physical stop for the roller of the short pallet, preventing said pallet from lifting.

Additionally and according to another of the features of the invention, it is provided that said counter-guide incorporates a sensor in the form of a band so that at the moment in which the mentioned roller of the short pallet makes contact with such sensor, a signal is generated to the mechanical walkway control element (PLC), carrying out the instantaneous stop or functional interruption of said walkway, which will be maintained over time while the breakdown is not repaired and the maintenance technicians reset the system.

BRIEF DESCRIPTION OF THE DRAWINGS

To complement the description being made and for the object of aiding to better understand the features of the invention according to a preferred practical embodiment thereof, a set of drawings is attached as an integral part of said specification, in which the following has been shown with an illustrative and non-limiting character.

DETAILED DESCRIPTION OF THE PREFERRED EMBODIMENT(S)

Figure 1:
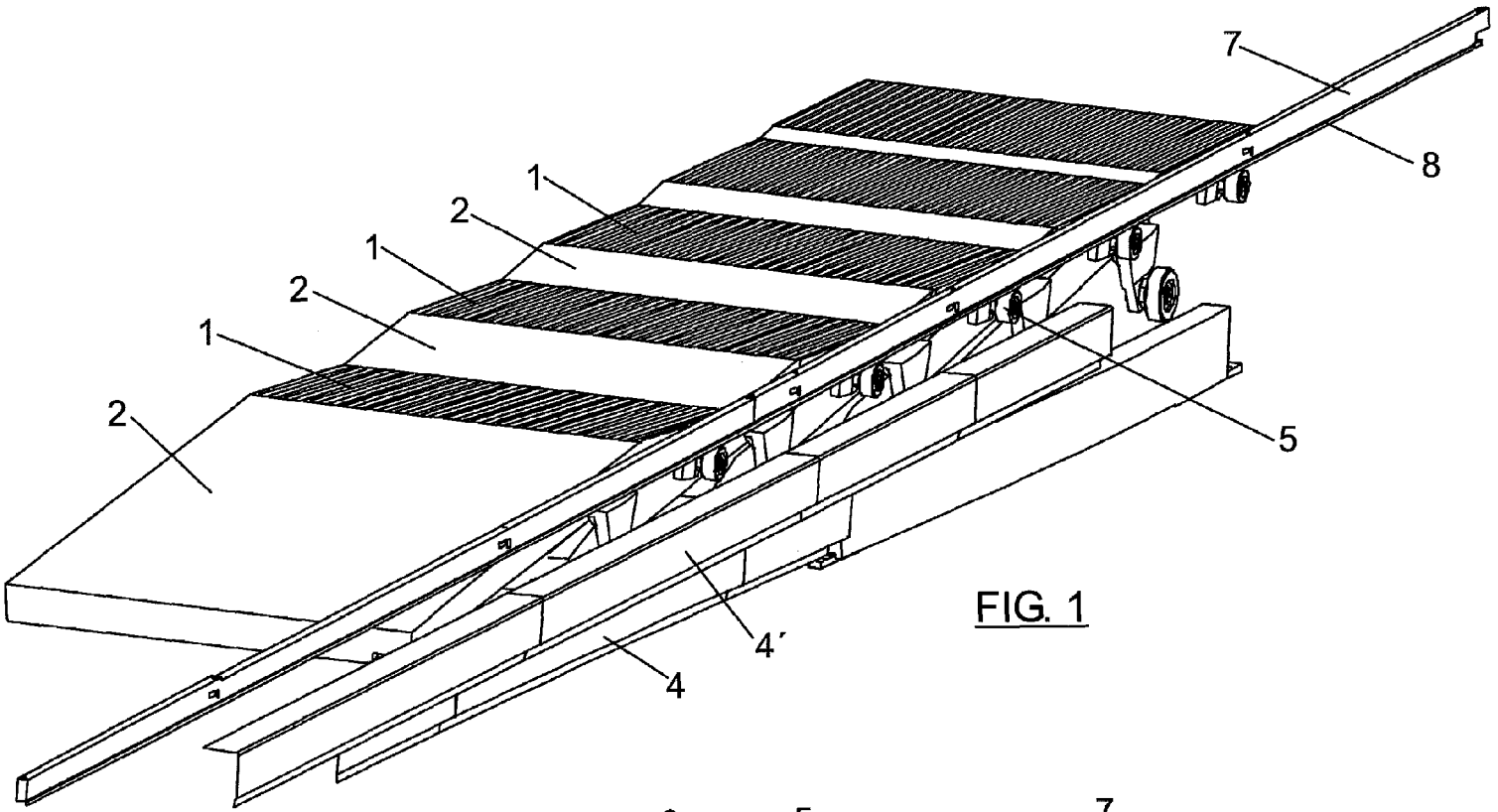
FIG. 1 shows a partial perspective view of a mechanical walkway provided with the safety device forming the object of the present invention.

In view of the figures described, it can be observed how the safety device proposed by the invention is applicable to mechanical walkways in which there are plates or long pallets (1) alternately arranged with short pallets (2), both being able to move relatively to one other in the acceleration and deceleration areas of the walkway, as shown in FIG. 1, such that since said plates are grooved, the distance between each pair of pallets (1-2) can vary, increasing or decreasing according to if the intention is to obtain an accelerated or decelerated movement, as is also observed in FIG. 1.

Figure 2:
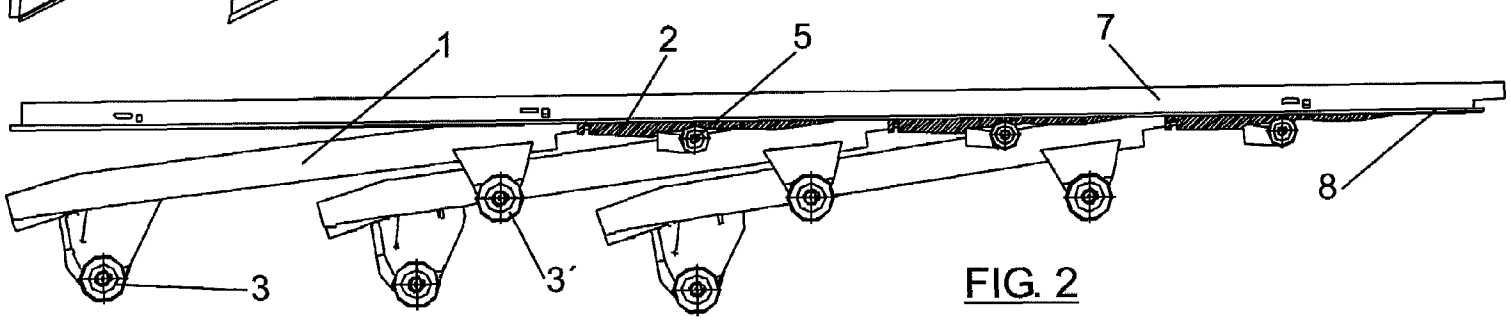
FIG. 2 shows a side elevational view of the assembly shown in the previous figure, lacking the guides in order to show the structure more clearly.
Figure 3:
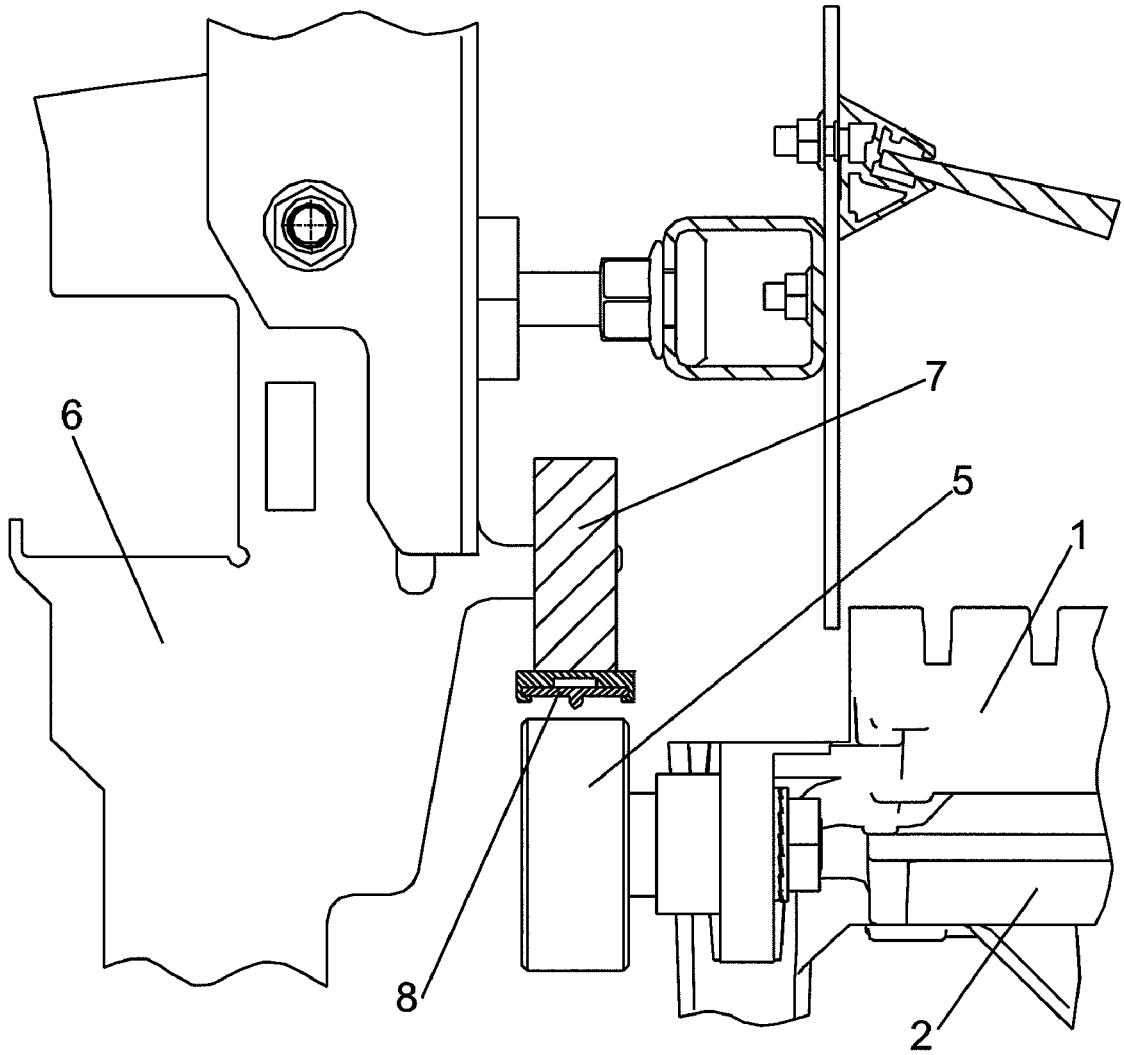
FIG. 3 shows finally a cross-section detail of the assembly of the previous figures.

As is also conventional, the long pallets (1) incorporate on each of their edges pairs of rollers (3, 3') considerably spaced from one another and offset in height, as can be observed in FIG. 2, that slide through their respective guides (4-4') operationally arranged at the sides of the walkway.

In turn the short pallets (2), hingedly joined to the long pallets (1) inside each pair of pallets, incorporate a single roller (5) on each side, sliding on the upper guide (4') of the previously mentioned pallets, in the constant speed area, and in the speed variation areas, the short pallet (2) slides on the long pallet (1), the roller (5) of the short pallet (2) not having guided support in its movement, such that provisionally said short pallet (2) can be tilted upwards through its joining axis hinged to the corresponding long pallet (1).

According to the invention a counter-guide (7) is arranged on the mentioned rollers (5) of the short pallets (2) and conveniently integral to the fixed structure (6) of the mechanical walkway, which counter-guide is especially visible in the section of FIG. 2 and prevents the roller (5) from tilting upwards due to any obstacle or inappropriate manipulation, since each short pallet (2) slides perfectly guided between the long pallet (1) and the counter-guide (7) by means of the rollers (5).

Finally, the mentioned guide (7) incorporates on its lower edge, the one closest to the rollers (5), a sensor (8) in the form of a band on which any roller (5) tending to be lifted by the tilting effect of the corresponding short pallet would first act, which sensor, due to contact with one of the rollers (5), generates a signal fed to the mechanical walkway control equipment, i.e. the PLC, which causes the instantaneous functional stop of the walkway if the breakdown causing such incidence is not solved.

As has been said previously and once the problem that caused the stop of the mechanical walkway is solved, the system will need to be reset so that said walkway can begin its normal operation again.

The invention claimed is:

1. A safety device for transport systems comprising walkways and stairs by means of moving elements with longitudinal movements in which there is the possibility that said moving elements undergo tilting movements in relation to an operating direction, wherein it comprises:

a counter guide above said moving elements, having stop functions, in order to prevent upwards tilting of the moving elements; and comprising on a lower face, a sensor in the form of a band configured so that upon coming into contact with a moving element, a signal is generated towards a control circuit in order to cause a functional stop of the transport system.

2. The device of claim 1, wherein the safety counter-guide is arranged in a lateral position.

* * * * *